US007784779B2

(12) United States Patent
Choi

(10) Patent No.: US 7,784,779 B2
(45) Date of Patent: Aug. 31, 2010

(54) APPARATUS FOR DISCHARGING WAD OF MEDIA IN AUTOMATED MEDIA DISPENSER

(75) Inventor: Woon-Yong Choi, Pyeongtaek (KR)

(73) Assignee: LG N-Sys Inc., Seoul (KR)

( * ) Notice: Subject to any disclaimer, the term of this patent is extended or adjusted under 35 U.S.C. 154(b) by 379 days.

(21) Appl. No.: 11/959,179

(22) Filed: Dec. 18, 2007

(65) Prior Publication Data

US 2008/0185394 A1 Aug. 7, 2008

(30) Foreign Application Priority Data

Feb. 5, 2007 (KR) ..... 10-2007-0011710

(51) Int. Cl.
*B65H 5/22* (2006.01)
*B65H 31/00* (2006.01)

(52) U.S. Cl. ..... 271/3.01; 271/273; 271/207; 414/790.7

(58) Field of Classification Search ..... 271/3.01, 271/3.03, 273, 274, 207, 213; 414/790.7; 902/15, 17

See application file for complete search history.

(56) References Cited

U.S. PATENT DOCUMENTS 3,661,383 A * 5/1972 Morrison ..... 271/273
4,358,103 A * 11/1982 Koike et al. ..... 271/248
4,618,302 A * 10/1986 Kokubo et al. ..... 414/789.9
5,927,936 A * 7/1999 Arikawa et al. ..... 414/788
6,598,870 B2 * 7/2003 Hanano ..... 271/138
6,644,657 B2 * 11/2003 Wright et al. ..... 271/242
7,176,955 B2 * 2/2007 Tanabe ..... 347/215
7,325,802 B2 * 2/2008 Asakawa et al. ..... 271/273

* cited by examiner

*Primary Examiner*—David H Bollinger
(74) *Attorney, Agent, or Firm*—Birch, Stewart, Kolasch & Birch, LLP

(57) ABSTRACT

The present invention relates to an apparatus for discharging a wad of media in an automated media dispenser. The present invention provides an apparatus for discharging a wad of media in an automated media dispenser, comprising: a main frame 30; a lower frame 61 provided in the main frame 30, the lower frame being provided with a lower media delivery unit 70 for conveying media in one direction; a delivery regulating unit 90 provided in the lower frame 61 to selectively convey the media; an upper frame 32 provided in the main frame 30 in correspondence to an upper side of the lower frame 61 and being selectively in contact with the lower frame 61, the upper frame being provided with an upper media delivery unit 40, the upper media delivery unit cooperating with the lower media delivery unit 70 to convey the media in one direction; and a delivery regulation operating unit 50 provided in the upper frame 32 to selectively operating the delivery regulating unit 90. According to the present invention so configured, there is an advantage in that the media in a wad shape provided to a customer so that a convenience of the user is enhanced.

20 Claims, 9 Drawing Sheets

APPARATUS FOR DISCHARGING WAD OF MEDIA IN AUTOMATED MEDIA DISPENSER

BACKGROUND OF THE INVENTION

1. Field of the Invention

The present invention relates to an apparatus for discharging a wad of media in an automated media dispenser, and more particularly, to an apparatus for discharging a wad of media in an automated media dispenser which conveys and deliveries media to a customer.

2. Description of the Related Art

The term "media" used herein indicates, for example, bills, checks, tickets, certificates, and the like. The media include various objects having a very small thickness compared with width or length thereof.

An automated media dispenser dispenses media by the request for dispensing the media inputted by a customer. As compared with a case where a person in charge of dispensing media directly provides a customer with media, the automated media dispenser can dispense the media to the customer more rapidly and conveniently, so that applications of the automated media dispenser have been expanded.

A conventional automated media dispenser is illustrated in FIG. 1. As shown in the figure, a frame 1 is provided with a customer access module 10 through which a customer can receive media 3. The media 3 are conveyed to the customer access module 10 by a feed module (not shown) and a delivery module (not shown) provided in the frame 1.

The customer access module 10 is provided with a media accumulating box 11. The media accumulating box 11 has an upper portion opened and an accumulating space 11' defined therein. An accumulating surface 13 is formed on one surface of the accumulating space 11', so that the media 3 are accumulated on the accumulating surface 13. The opened upper portion of the media accumulating box 11 is selectively opened and closed by a box door 15.

The customer access module 10 is provided with a media discharge unit 20 in which the media 3 conveyed through the delivery module are discharged to the media accumulating box 11. In the media discharge unit 20, rollers 23 are provided for conveying the media 3 toward a discharging outlet 21. The rollers 23 facing each other are rotated opposite to each other to convey the media 3 to the discharging outlet 21 formed between the rollers 23. That is, a conveyer belt 25 is connected to the rollers 23, so that the media 3 is conveyed by the conveyer belt 25 which moves by the roller 23.

However, the automated media dispenser according to the prior art as described above has the problems as follows.

The media 3 are conveyed toward the discharging outlet 21 by the conveyer belt 25 which moves by the rollers 23. The media 3 discharged through the discharging outlet 21 fall freely into the accumulating space 11' of the media accumulating box 11. Since the media 3 falling freely into the accumulating space 11' are accumulated on the accumulating surface 13 of the accumulating space 11', there is a problem in that an accumulated state of the media 3 is not good.

SUMMARY OF THE INVENTION

The present invention is conceived to solve the aforementioned problems in the prior art. An object of the present invention is to provide an apparatus for discharging a wad of media in an automated media dispenser, in which media discharged from a discharging outlet can be preferably accumulated.

According to an aspect of the present invention for achieving the objects, there is provided an apparatus for discharging a wad of media in an automated media dispenser, comprising: a main frame; a lower frame provided in the main frame, the lower frame being provided with a lower media delivery unit for conveying media in one direction; a delivery regulating unit provided in the lower frame to selectively convey the media; an upper frame provided in the main frame in correspondence to an upper side of the lower frame and being selectively in contact with the lower frame, the upper frame being provided with an upper media delivery unit, the upper media delivery unit cooperating with the lower media delivery unit to convey the media in one direction; and a delivery regulation operating unit provided in the upper frame to selectively operating the delivery regulating unit.

An upper plate of the lower frame may be separated from the lower frame and provided to be movable in a vertical direction along a guide formed on a side surface of the lower frame.

A lower elastic member may be further provided in an inner space of the lower frame, the lower elastic member supporting the upper plate of the lower frame and providing elastic force so that the lower frame in contact with the upper frame when the lower frame is brought into close contact with the upper frame, the lower elastic member is a compression spring.

The lower media delivery unit may comprise a plurality of lower delivery rods installed rotatably on the lower frame; a plurality of lower rollers provided on the lower delivery rod, the lower roller being rotated together with the lower delivery rod and selectively protruding through a through hole formed on the upper plate of the lower frame; a lower power transmission unit provided in the lower frame and connected to the lower delivery rod to rotate the lower delivery rod; and a lower power source provided in the lower frame and generating power to be transmitted to the lower delivery rod.

The lower power transmission unit may comprise a plurality of gears connected to the lower delivery rods to transmit power; and a plurality of connecting chains wound on the gears.

The delivery regulating unit may comprise a delivery regulation rod provided rotatably on the lower frame; a delivery regulation plate provided on the delivery regulation rod and being rotated together with the delivery regulation rod to selectively block the movement of the media; and an operating bar provided on the delivery regulation rod for selectively rotating the delivery regulation rod.

The operating bar may be bent at least one point.

The upper media delivery unit may comprise a plurality of upper delivery rods provided rotatably on the upper frame; a plurality of upper rollers provided on the upper delivery rod and being rotated together with the upper delivery rod; and a plurality of connecting belts connected to the upper rollers to be rotated together with the upper rollers, the connecting belt being wound on the upper rollers provided on another of the upper delivery rods.

The upper delivery rod may be movable vertically along a moving rail slot formed on a side surface of the lower frame.

The upper frame may be further provided with an upper elastic member for providing elastic force so that the upper frame is in close contact with the lower frame when the upper frame is in close contact with the lower frame, the upper elastic member is the compression spring.

An end of the upper elastic member may be fixed to the upper frame and the other end thereof may be connected to the upper delivery rod.

The apparatus may further comprise a power transmission gear provided at one end of the upper delivery rod and meshed with the gear of the lower frame to transmit the power of the lower power source to the upper assembly.

The delivery regulation operating unit may comprise a delivery regulation operating rod provided rotatably on the upper frame; an eccentric plate provided at one end of the delivery regulation operating rod and pushing the operating bar of the delivery regulating unit to rotate the operating bar; and a connecting link connecting the delivery regulation operating rod and the eccentric plate, the connecting link having both ends respectively connected to the upper frame and the main frame.

The eccentric plate may comprise a circular portion connected to the end of the connecting link and a protrusion portion in contact with the operating bar to rotate the operating bar.

The main frame may be further provided with an upper power source for providing power for selectively rotating the delivery regulation plate.

According to another aspect of the present invention, there is provided an apparatus for discharging a wad of media in an automated media dispenser, comprising: a main frame; a lower frame provided in the main frame, the lower frame being provided with a lower media delivery unit for conveying media in one direction; a delivery regulating unit including a delivery regulation rod provided rotatably on the lower frame, a delivery regulation plate provided on the delivery regulation rod and being rotated together with the delivery regulation rod to selectively block the movement of the media, and an operating bar provided on the delivery regulation rod for selectively rotating the delivery regulation rod; an upper frame provided in the main frame in correspondence to an upper side of the lower frame and being selectively in contact with the lower frame, the upper frame being provided with an upper media delivery unit, the upper media delivery unit cooperating with the lower media delivery unit to convey the media in one direction; and a delivery regulation operating unit provided in the upper frame to selectively operating the delivery regulating unit.

The operating bar may be bent at least one point.

An upper plate of the lower frame may be separated from the lower frame and may be provided to be movable in a vertical direction along a guide formed on a side surface of the lower frame.

A lower elastic member may be further provided in an inner space of the lower frame, the lower elastic member supporting the upper plate of the lower frame and providing elastic force so that the lower frame in contact with the upper frame when the lower frame is brought into close contact with the upper frame, the lower elastic member is a compression spring.

The lower media delivery unit may comprise a plurality of lower delivery rods installed rotatably on the lower frame; a plurality of lower rollers provided on the lower delivery rod, the lower roller being rotated together with the lower delivery rod and selectively protruding through a through hole formed on the upper plate of the lower frame; a lower power transmission unit provided in the lower frame and connected to the lower delivery rod to rotate the lower delivery rod; and a lower power source provided in the lower frame and generating power to be transmitted to the lower delivery rod.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENT

Figure 1:
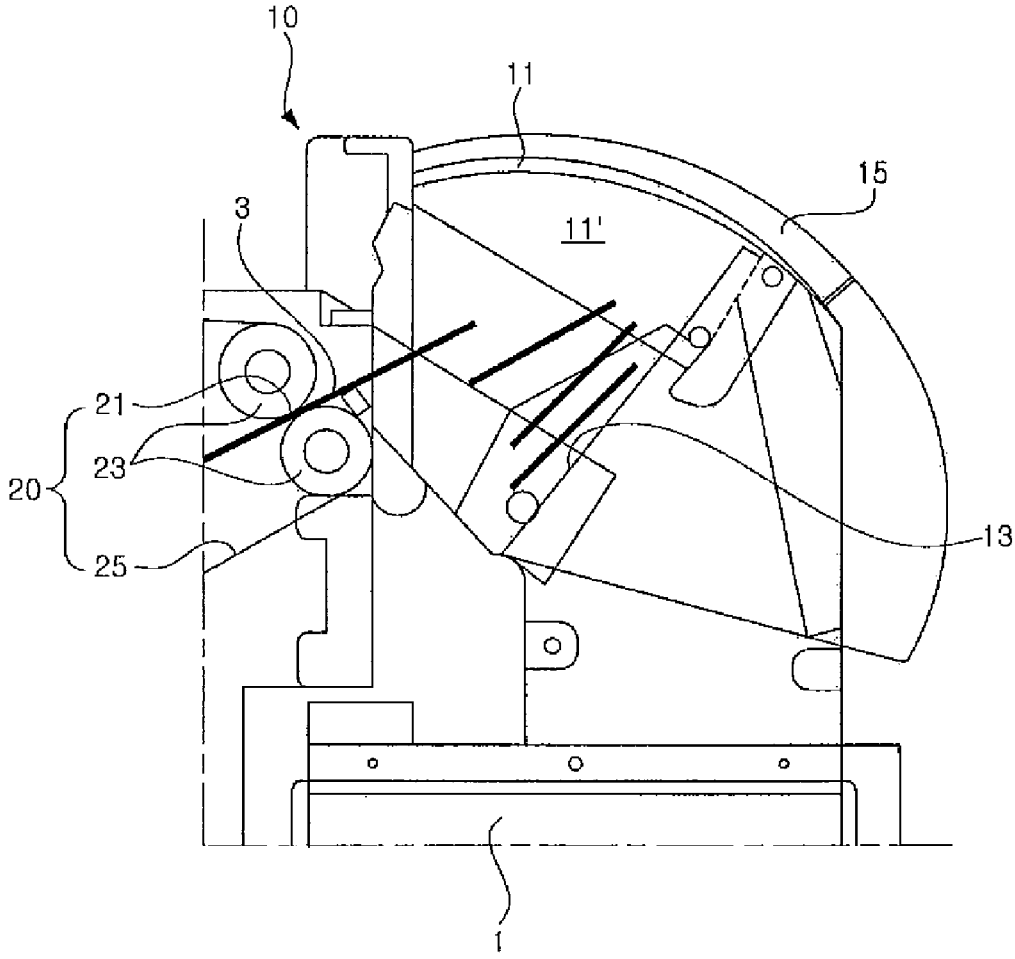
FIG. 1 is a sectional view showing an interior of an apparatus for discharging a wad of media in an automated media dispenser according to a prior art.
Figure 2:
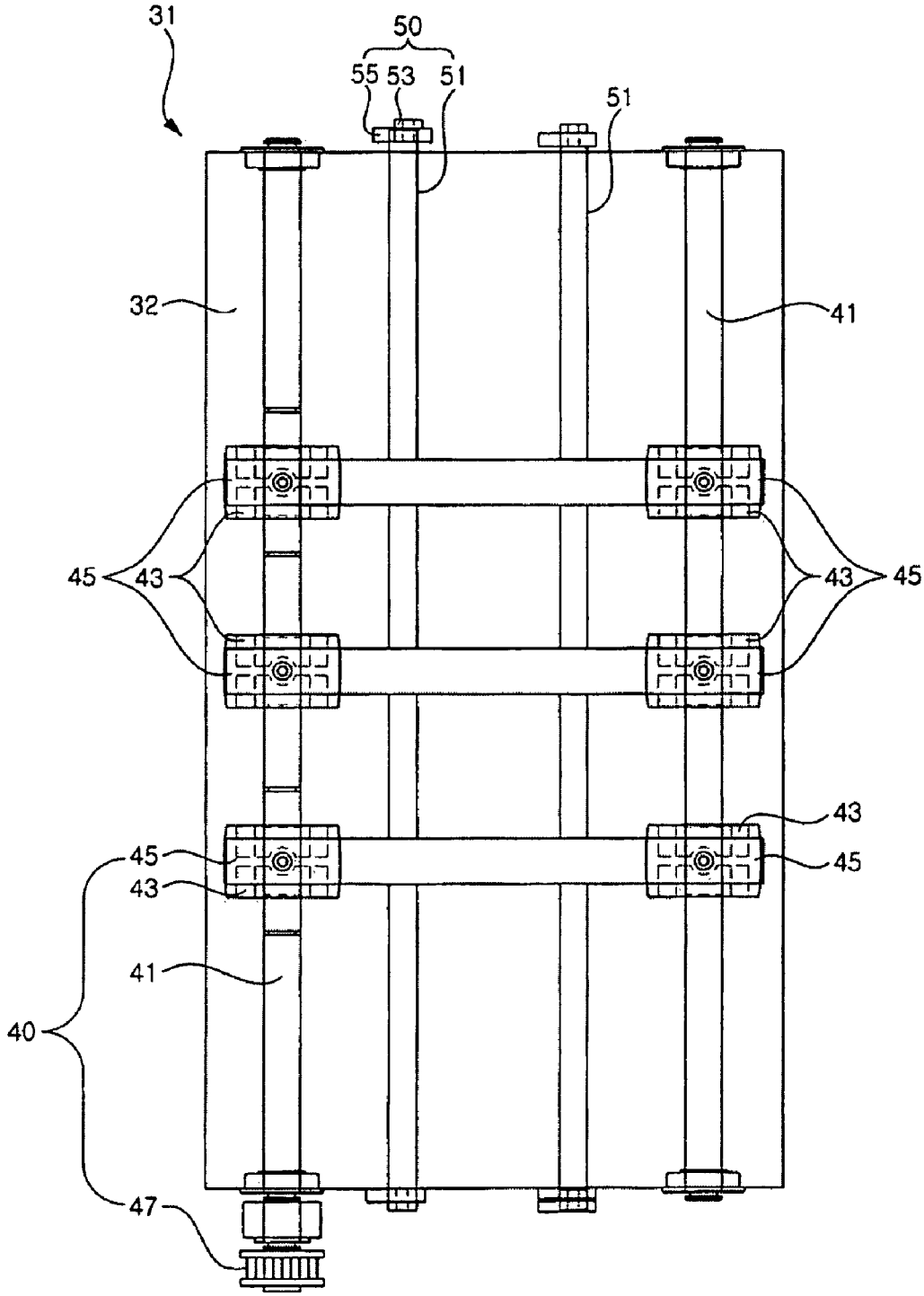
FIG. 2 is a plane view showing an upper assembly of a preferred embodiment of an apparatus for discharging a wad of media in an automated media dispenser according to the present invention.
Figure 3:
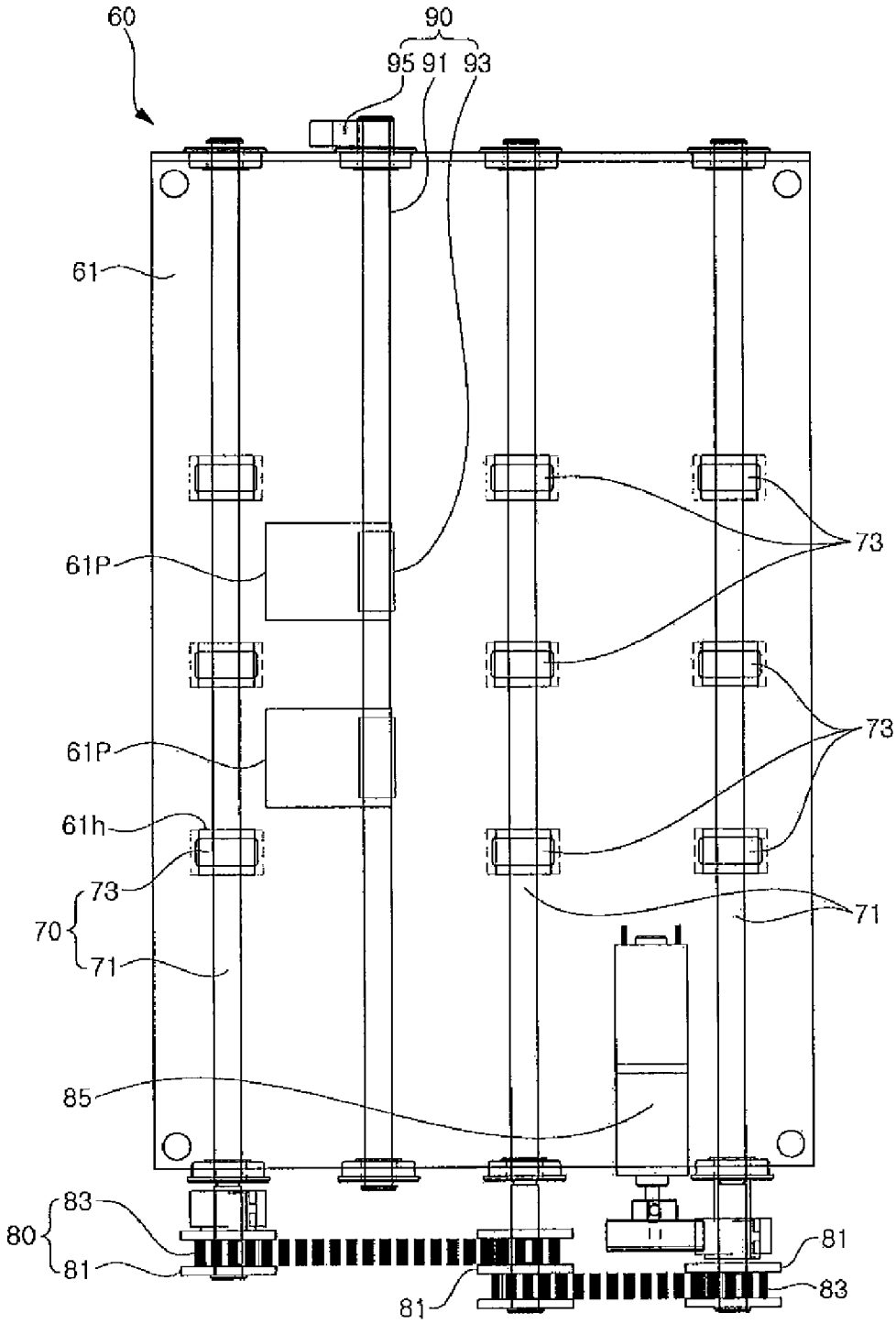
FIG. 3 is a plane view showing a lower assembly of the preferred embodiment of the apparatus for discharging a wad of media in an automated media dispenser according to the present invention.

Hereinafter, a preferred embodiment of an apparatus for discharging a wad of media in an automated media dispenser according to the present invention will be described in more detail with reference to the accompanying drawings.

FIGS. 2 to 7 show the preferred embodiment of the apparatus for discharging a wad of media in an automated media dispenser according to the present invention.

As shown in the figures, an upper assembly 31 is provided in a main frame 30 (see FIG. 4), an upper frame 32 defining a framework of the upper assembly 31 is provided in the upper frame 31. The main frame 30 is formed in a generally rectangular shape, and a space is defined in the main frame so that the upper frame 32 and a lower frame 61 to be described below are provided in the space of the main frame. The upper frame 32 is formed in a plate shape, and components of the upper assembly 31 are installed to the upper frame 32. A delivery module (not shown) for conveying the media is connected to a media entry side of the main frame 30.

Figure 5:
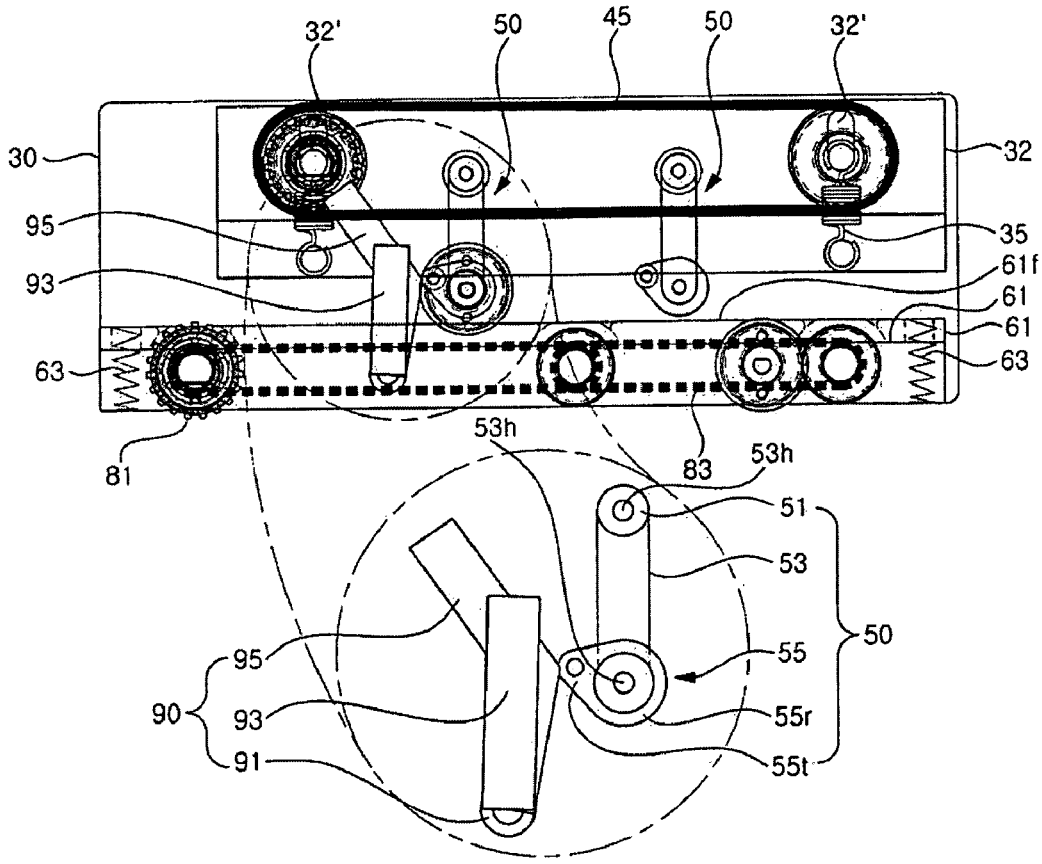
FIG. 5 is a side sectional view of FIG. 4.
Figure 6:
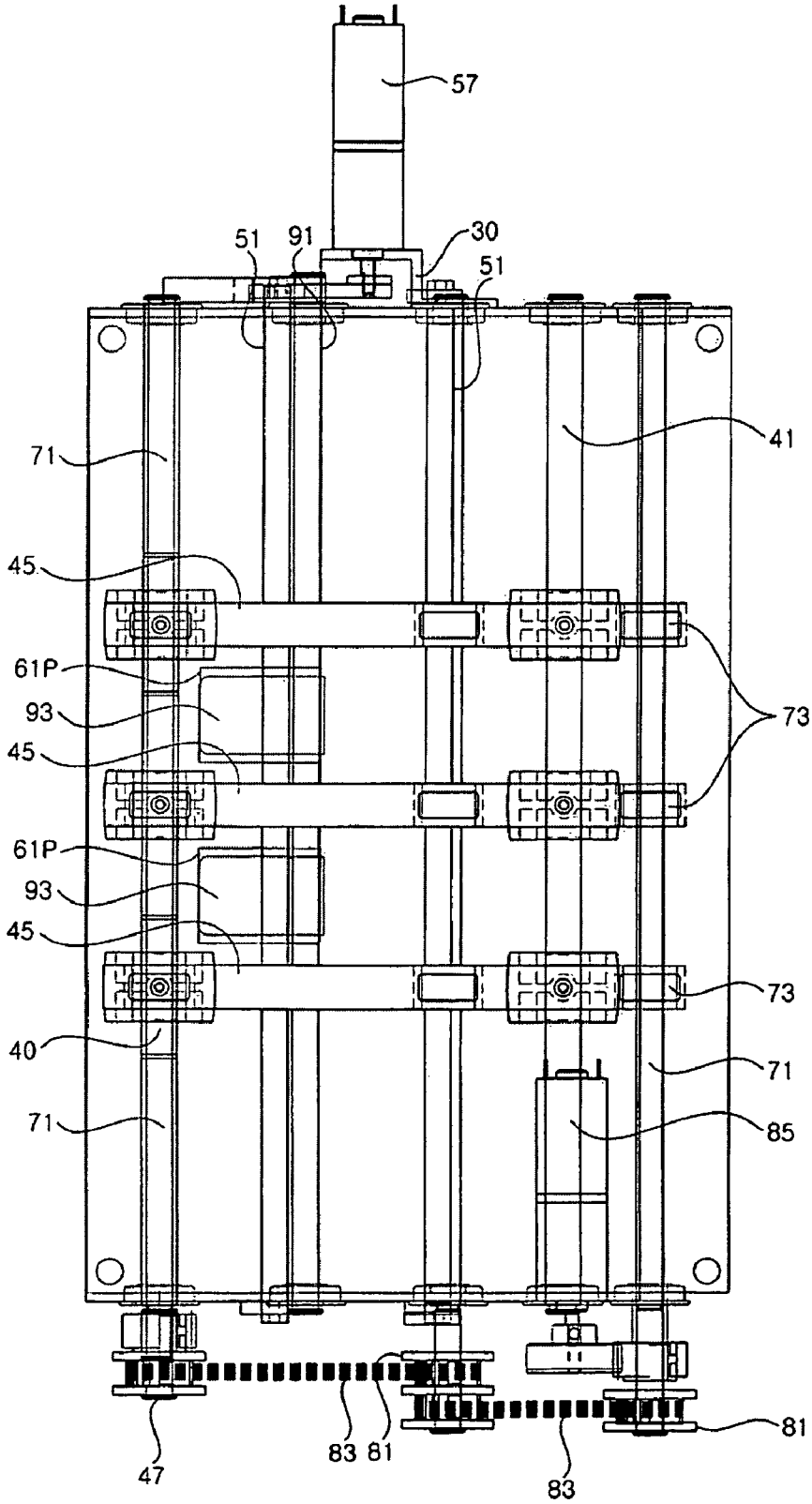
FIG. 6 is a plane view showing that the upper and lower assemblies of the preferred embodiment of the apparatus for discharging a wad of media in an automated media dispenser according to the present invention are in close contact with each other.
Figure 7:
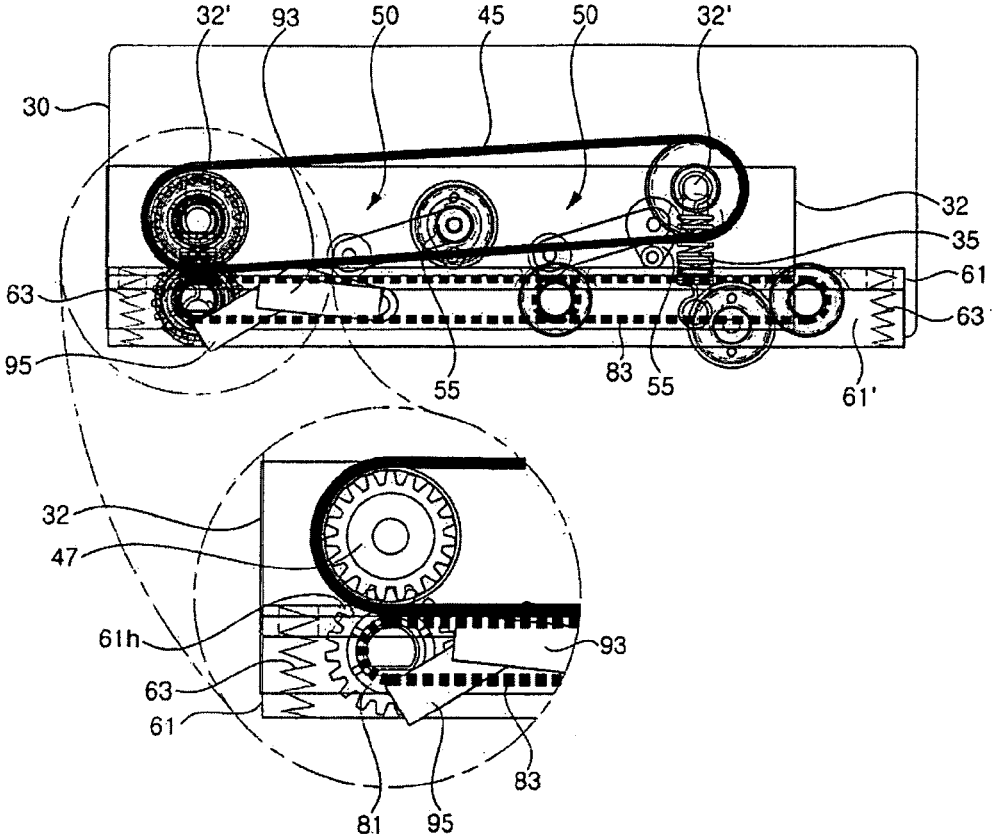
FIG. 7 is a side sectional view of FIG. 6.

As shown in FIG. 5, moving rail slots 32' are formed on side surfaces of the upper frame 32 to move upper delivery rods 41 that will be described later. The moving rail slot 32' is formed to extend vertically upward, and one end of the upper delivery rod 41 is seated in the moving rail slot 32'.

In addition, an upper elastic member 35 connected to the upper delivery rod 41 is provided in the upper frame 32. A compression spring or the like may be used as the upper elastic member 35. The upper elastic member 35 causes the upper frame 32 to be in close contact with the lower frame 61 to be described below.

An upper media delivery unit 40 is provided in the upper frame 32 for conveying the media input into the upper assembly 31 in one direction. The upper media delivery unit 40 is provided with the upper delivery rods 41 which are rotatably installed at both ends of the upper frame 32. The upper delivery rods 41 are spaced apart from each other by a certain interval, and one of them is provided at each of front and rear sides in a direction in which the media are input.

Both ends of the upper delivery rod 41 are seated in the moving rail slots 32' of the upper frame 32. In addition, one end of the upper elastic member 35 is connected to the upper delivery rod 41 and the other end thereof is connected to the upper frame 32. Accordingly, the upper elastic member 35 connected to the upper delivery rod 41 is stretched when the upper frame 32 is brought into close contact with the lower frame 61 and then the upper delivery rod 41 moves vertically upward along the moving rail slots 32'. In addition, if the upper frame 32 is spaced apart from the lower frame 61, the upper delivery rod 41 returns to its origin position by restoring force of the upper elastic member 35.

A plurality of upper rollers 43 are provided on the upper delivery rod 41 to be spaced apart from each other at certain intervals. A connecting belt 45 is wound on upper rollers 43 respectively provided on the upper delivery rods 41. The upper rollers 43 respectively provided on the upper delivery rods 41 are rotated together by means of the connecting belt 45.

A power transmission gear 47 is further provided on an end of one of the upper delivery rods 41, which is located at a position at which the media is discharged. The power transmission gear 47 is meshed with one of gears 81, which will be described later, to transmit power generated in a lower power source 85 to the upper delivery rod 41.

As shown in FIG. 5, the upper frame 32 is provided with a delivery regulation operating unit 50 for operating selectively a delivery regulating unit 90, which will be described later. The delivery regulation operating unit 50 is provided with delivery regulation operating rods 51, which are rotatably installed to the upper frame 32. A connecting link 53 extending toward the lower frame 61 to be described below is provided at one end of the delivery regulation operating rod 51.

Hinge pins 53*h* are provided at one end of the connecting link 53 connected to the main frame 30 and the other end thereof connected to the upper frame 32, respectively. Both the ends of the connecting link 53 are rotatably connected to the main frame 30 and the upper frame 32, respectively, through the hinge pins 53*h*.

An eccentric plate 55 for operating the delivery regulating unit 90, which will be described later, is provided at the end of the connecting link 53 connected to the main frame 30. The eccentric plate 55 consists of a circular portion 55*r* connected to the end of the connecting link 53 and a protrusion portion 55*t* protruding from a portion of the circular portion 55*r*. The protrusion portion 55*t* is in contact with an operating bar 95 of the delivery regulating unit 90 to operate the delivery regulating unit 90.

Figure 4:
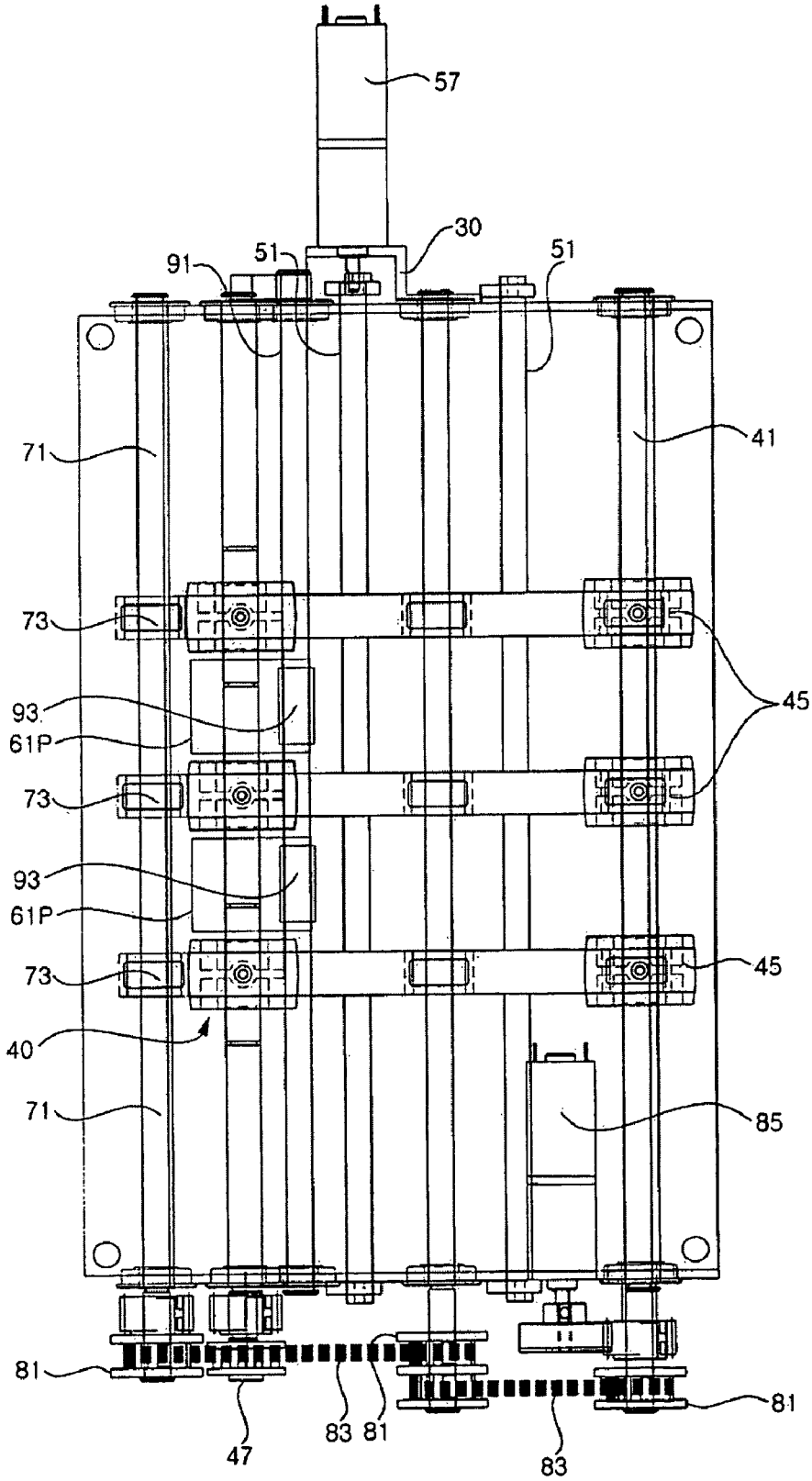
FIG. 4 is a plane view showing that the upper and lower assemblies of the preferred embodiment of the apparatus for discharging a wad of media in an automated media dispenser according to the present invention are spaced apart from each other.

In addition, the end of the connecting link 53 is rotatably connected to one side surface of the main frame 30 through the hinge pin 53*h*. Accordingly, the end of the connecting link 53 is rotatably connected to the main frame 30 and the other end thereof is rotatably connected to the upper frame 32, so that the upper frame 32 is supported to the main frame 30. As shown in FIG. 4, an upper power source 57 is provided at a point at which the connecting link 53 is connected to the main frame 30. The connecting link 53 is rotated about a point, at which the connecting link 53 is connected to the main frame 30, by the upper power source 57, and the eccentric plate 55 provided together with the connecting link 53 is also rotated to rotate the delivery regulating unit 90.

In the main frame 30, a lower assembly 60 is provided under the upper assembly 31. The lower assembly 60 is provided with the lower frame 61, which is formed corresponding to the upper frame 32. The lower frame 61 is formed in a general rectangular shape and has an inner space 61' defined therein as shown in FIG. 5. The lower frame 61 and an upper plate 61*f* thereof are provided separately from each other. The upper plate 61*f* of the lower frame 61 is configured to be moved vertically along a guide (not shown) formed on a side surface of the lower frame 61 and not to escape from the lower frame 61.

In addition, a plurality of through holes 61*h* are formed in the upper plate 61*f* of the lower frame 61 in contact with the upper frame 32. Lower rollers 73, which will be described later, selectively protrude through the through holes 61*h*. In addition, a plurality of protrusion holes 61*p* are formed in a surface of the lower frame 61 in contact with the upper frame 32. A delivery regulation plate 93, which will be described later, protrudes through the protrusion holes 61*p*.

A lower elastic member 63 is provided in an inner space 61' of the lower frame 61. A compression spring may be used as the lower elastic member 63. The upper plate 61*f* of the lower frame 61 is configured to be separated from a side surface of the lower frame 61, and the lower elastic member 63 is provided between the upper plate 61*f* and a lower plate of the lower frame 61. Accordingly, when the lower frame 61 is brought into close contact with the upper frame 32, the upper plate 61*f* of the lower frame 61 compresses the lower elastic member 63 and is moved downward. Further, when the lower frame 61 is spaced apart from the upper fame 32, the upper plate 61*f* is moved upward to return to its origin position by elastic force of the lower elastic member 63.

A lower media delivery unit 70 for conveying the media input between the upper assembly 31 and the lower assembly 60 in one direction is provided in the inner space 61' of the lower frame 61. The lower media delivery unit 70 is provided with a plurality of lower delivery rods 71 each of which is rotatably installed at both ends of the lower frame 61. The plurality of lower delivery rods 71 are spaced apart from each other at certain intervals in the lower frame 61.

A plurality of lower rollers 73 are provided on the lower delivery rod 71. The lower roller 73, which is used for conveying the media input into the lower frame 61, may have a rubber material with elasticity formed on outer circumference surface thereof The lower rollers 73 are spaced apart from each other at certain intervals on the lower delivery rod 71 and rotated together with the lower delivery rod 71. The lower rollers 73 selectively protrude through the through holes 61*h* of the lower frame 61.

That is, since the upper plate 61*f* of the lower frame 61 is supported by the lower elastic member 63, when the lower frame 61 is in close contact with the upper frame 32, the upper plate 61*f* of the lower frame 61 is moved downward along the guide. Then, the lower rollers 73 fixedly installed on a side surface of the lower frame 61 protrude through the through holes 61*h*. In addition, when the lower frame 61 becomes spaced apart from the upper frame 32, the upper plate 61*f* of the lower frame 61 is moved upward by elastic force of the lower elastic member 63, so that the lower rollers 73 are inserted into the lower frame 61.

A lower power transmission unit 80 and the lower power source 85 are provided on a side of the lower frame 61 to rotate the lower delivery rod 71. The lower delivery rod 71 is rotated by the lower power transmission unit 80 and the lower power source 85, and thus, the lower rollers 73 formed integrally with the lower delivery rod 71 are rotated together with the lower delivery rod to convey the media.

The lower power transmission unit 80 is provided with the gears 81 respectively connected to the lower delivery rods 71. The power generated in the lower power source 85 is transmitted to one of the gears 81. There is provided with a connecting chain 83 which is wound on two of the gears 81. The gears 81 are connected to each other through the connecting chain 83, so that the gears 81 are simultaneously rotated.

The lower power source 85 providing power for rotating the lower delivery rod 71 is provided in the lower frame 61. The lower power source 85 provides power for rotating the lower delivery rod 71. The lower power source 85 causes the lower delivery rod 71 to rotate, and another of the lower delivery rods 71 is simultaneously rotated by means of the connecting chains 83 and the gears 81 provided at one ends of the lower delivery rods 71.

The gear 81 is also provided on the lower delivery rod 71 at a position corresponding to the power transmission gear 47 of the upper frame 32. Accordingly, the a power generated in the lower power source 85 is transmitted to the upper assembly 31 by way of a geared-coupling between the gear 81 and the power transmission gear 47.

Figure 9:
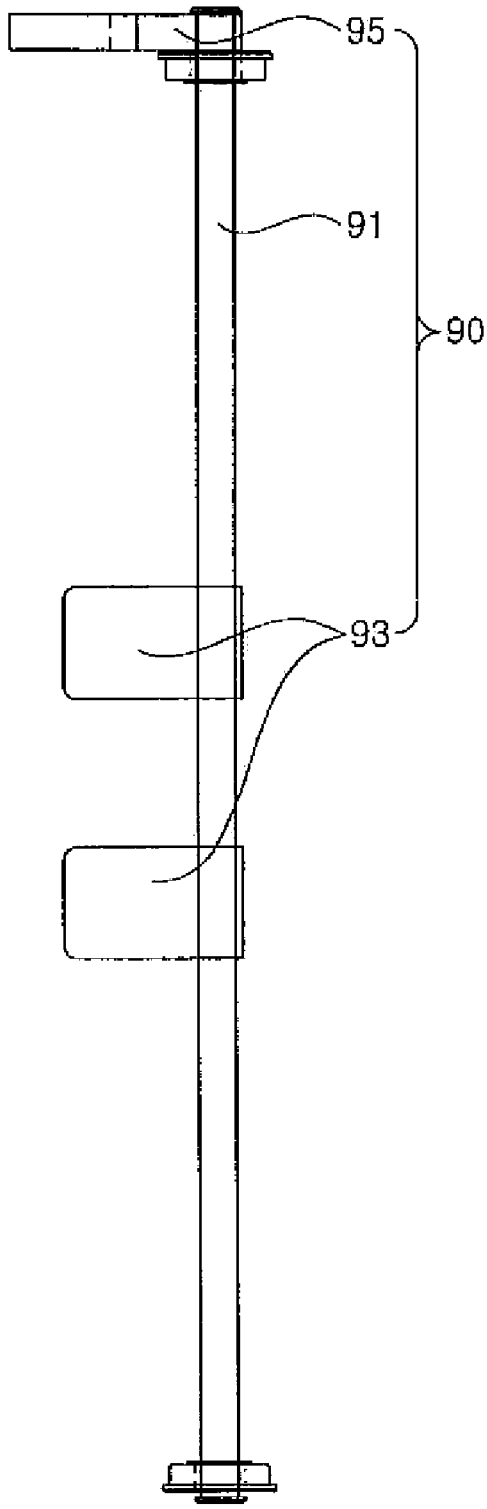
FIG. 9 is a plane view showing a transfer regulating means of the apparatus for discharging a wad of media in an automated media dispenser according to the present invention.

Referring to FIG. 9, the delivery regulating unit 90 is provided in the lower frame 61 to selectively convey the media. The delivery regulating unit 90 is provided with a delivery regulation rod 91, which is rotatably connected to both the ends of the lower frame 61. A torsion spring (not shown) is provided on one end of the delivery regulation rod 91 to provide elastic force by which the delivery regulation rod 91 returns to its origin location after rotating at certain angles.

The delivery regulation rod 91 is provided with a delivery regulation plate 93, which stands upright toward the upper frame 32. The delivery regulation plate 93 is provided to selectively block the movement of the media to be input into the lower frame 61. The delivery regulation plate 93 is rotated together with the delivery regulation rod 91 and then inserted into the inner space 61' of the lower frame 62 through the protrusion holes 61*p*. When the delivery regulation rod 91 rotates and returns to its origin location by the torsion spring, the delivery regulation plate 93 stands upright again toward the upper frame 32 through the protrusion hole 61*p*.

The operating bar 95 is provided on one end of the delivery regulation rod 91. Since the operating bar 95 rotates while being in contact with the protrusion portion 55*t* of the eccentric plate 55, the operating rod 95 is bent at a certain point. That is, the eccentric plate 55 rotates and pushes the bent portion of the operating bar 95 to rotate the operating bar 95, and one end of the connecting link 53 further pushes the operating rod 95 to rotate the operating rod 95 at a certain angle. The rotation of the operating bar 95 causes the delivery regulation plate 93 to also rotate.

Hereinafter, the operation of the apparatus for discharging a wad of media in an automated media dispenser according to the present invention having the aforementioned configurations will be described in detail.

Figure 8A:
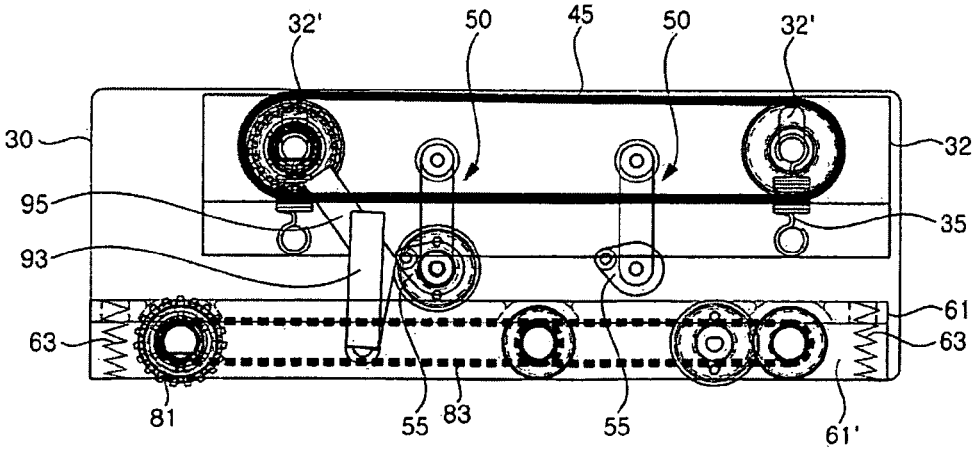
FIGS. 8*a* to 8*c* are views showing operating states of the apparatus for discharging a wad of media in an automated media dispenser according to the present invention.
Figure 8B:
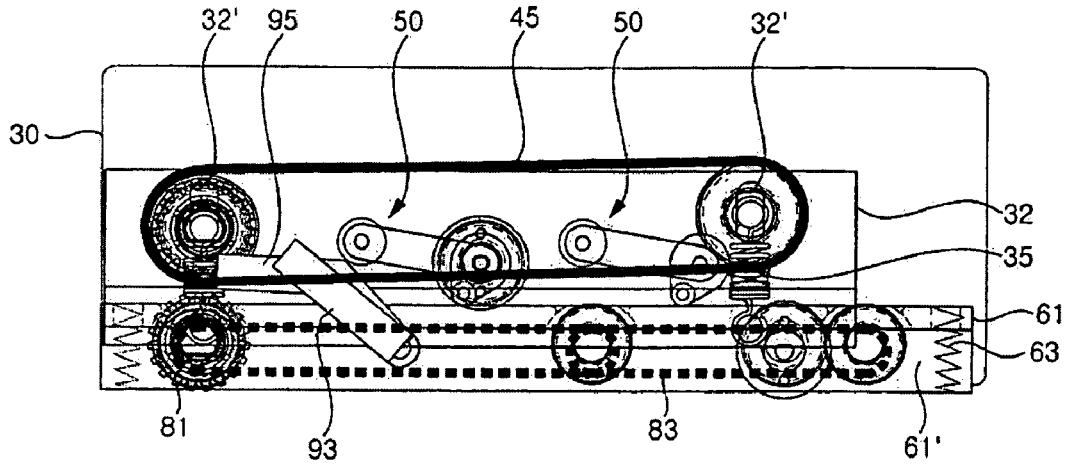
Figure 8C:
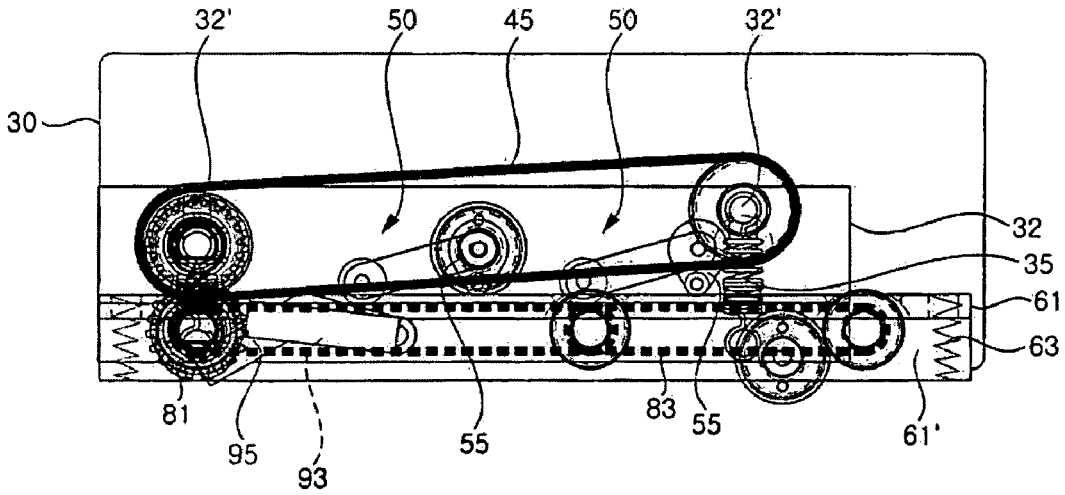

FIGS. 8*a* to 8*c* are views showing operating states of the apparatus for discharging a wad of media in an automated media dispenser according to the present invention. The configurations which are not shown in the above figures will be described with reference to the other figures.

As shown in the figures, the media are input into the main frame 30 through the delivery module connected to the main frame 30. The media are input between the upper assembly 31 and the lower assembly 60 provided in the main frame 30. At this time, the upper frame 32 is spaced apart from the lower frame 61. This state is illustrated in FIG. 8*a*.

If the media are input into the main frame 30, since the delivery regulation plate 93 of the lower frame 61 stands upright, the movement of the media is regulated by the delivery regulation plate 93. If the appropriate amount of the media is accumulated by the delivery module, the media are input into the main frame 30 no more and the upper power source 57 of the main frame 30 operates. The connecting link 53 connected to the upper power source 57 is rotated by the operation of the upper power source 57.

If the connecting link 53 rotates, as shown in FIG. 8*b*, the upper frame 32 connected to the end of the connecting link 53 is moved toward the lower frame 61. Then, the protrusion portion 55*t* of the eccentric plate 55 pushes one end of the operating bar 95 while the eccentric plate 55 provided together with the connecting link 53 is rotated. If the protrusion portion 55*t* pushes one end of the operating bar 95, one end of the connecting link 53 connected to the upper frame 32 is rotated downward to push one end of the operating bar 95.

If the operating bar 95 is pushed, the delivery regulation rod 91 provided together with the operating bar 95 is rotated together with the delivery regulation plate 93 provided together with the delivery regulation rod 91. The delivery regulation plate 93 is rotated and then seated in the inner space 61' through the protrusion holes 61*p* of the lower frame 61.

If the upper frame 32 is in close contact with the lower frame 61 by the rotation of the connecting link 53, the upper plate 61*f* of the lower frame 61 is moved vertically downward in a state where the upper plate is supported by the lower elastic member 63. Further, if the upper plate 61*f* of the lower frame 61 is moved downward while the upper plate compresses the lower elastic member 63, the lower roller 73 protrudes through the through hole 61*h* of the lower frame 61.

In addition, if the upper frame 32 is in close contact with the lower frame 61, the upper delivery rod 41 is moved vertically upward along the moving rail slot 32' of the upper frame 32. At this time, the upper elastic member 35 connecting the upper delivery rod 41 and the upper frame 32 is stretched. As the upper elastic member 35 is stretched, the upper frame 32 is brought into more close contact with the lower frame 61.

If the upper frame 32 is in close contact with the lower frame 61, the power transmission gear 47 provided on the upper frame 32 is meshed with the gear 81 of the lower frame 61. The connecting chain 83 is wound on the power transmission gear 47 and the gear 81.

If the upper frame 32 is in complete contact with the lower frame 61, the lower power source 85 operates. The lower delivery rod 71 is rotated together with the gear 81 by the operation of the lower power source 85, and the gear 81 is connected to the others of the gears 81 through the connecting chain 83, so that the others of the gears 81 are also rotated. When the gear 81 is rotated, the lower delivery rod 71 provided together with the gear 81 is rotated to rotate the lower rollers 73 provided on the lower delivery rod 71, so that the media are conveyed.

Further, the power transmission gear 47 meshed with the gear 81 is also rotated and the upper delivery rod 41 connected to the power transmission gear 47 is also rotated. When the upper delivery rod 41 is rotated, the upper rollers 43 provided on the upper delivery rod 41 are also rotated and the connecting belts 45 wound on the upper rollers 43 are rotated to convey the media.

The media are discharged out of the main frame 30 by the rotation of the connecting belts 45 of the upper assembly 31 and the rotation of the lower rollers 73 of the lower assembly 60. If the media are discharged out of the main frame 30, the upper power source 57 operates to move the upper frame 32 vertically upward again, and the connecting link 53 is also rotated by the movement of the upper frame 32 whereby the operating bar 95 returns to its origin position by the torsion spring. If the operating bar 95 returns, the delivery regulation plate 93 also protrudes again through the protrusion hole 61*p*.

The apparatus for discharging a wad of media in an automated media dispenser according to the present invention as described above has the advantage as follows.

First, the present invention is configured so that the media input into the main frame by the delivery regulation plate can be accumulated in the form of a wad. As described above, since the media accumulated in the form of a wad is provided to a customer by the upper and lower assemblies, the accumulated state of the media is preferable to thereby enhance the convenience of a user.

Although embodiments have been described with reference to a number of illustrative embodiments thereof it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and appended claims. In addition to variations and modifications in the component parts and/or arrangements, alternative uses will also be apparent to those skilled in the art.

What is claimed is:

1. An apparatus for discharging a wad of media in an automated media dispenser, comprising:

a main frame;

a lower frame provided in the main frame, the lower frame being provided with a lower media delivery unit for conveying media in one direction;

a delivery regulating unit provided in the lower frame to selectively convey the media;

an upper frame provided in the main frame in correspondence to an upper side of the lower frame, the upper frame being provided with an upper media delivery unit, the upper media delivery unit cooperating with the lower media delivery unit to convey the media in one direction; and a delivery regulation operating unit provided in the upper frame to selectively operating the delivery regulating unit.

2. The apparatus as claimed in claim 1, wherein an upper plate of the lower frame is separated from the lower frame and is provided to be movable in a vertical direction along a guide formed on a side surface of the lower frame.

3. The apparatus as claimed in claim 2, further comprising a lower elastic member in an inner space of the lower frame, the lower elastic member supporting the upper plate of the lower frame and providing elastic force.

4. The apparatus as claimed in claim 3, wherein the lower media delivery unit comprises:

a plurality of lower delivery rods installed rotatably on the lower frame;

a plurality of lower rollers provided on the plurality of lower delivery rods, the lower rollers being rotated together with the lower delivery rods and selectively protruding through a through hole formed on the upper plate of the lower frame;

a lower power transmission unit provided in the lower frame and connected to the lower delivery rod to rotate the lower delivery rod; and a lower power source provided in the lower frame and generating power to be transmitted to the lower delivery rod.

5. The apparatus as claimed in claim 4, wherein the lower power transmission unit comprises:

a plurality of gears connected to the lower delivery rods to transmit power; and a plurality of connecting chains wound on the gears.

6. The apparatus as claimed in claim 5, wherein the delivery regulating unit comprises:

a delivery regulation rod provided rotatably on the lower frame;

a delivery regulation plate provided on the delivery regulation rod and being rotated together with the delivery regulation rod to selectively block the movement of the media; and an operating bar provided on the delivery regulation rod for selectively rotating the delivery regulation rod.

7. The apparatus as claimed in claim 6, wherein the operating bar is bent at least one point.

8. The apparatus as claimed in claim 7, wherein the upper media delivery unit comprises:

a plurality of upper delivery rods provided rotatably on the upper frame;

a plurality of upper rollers provided on the plurality of upper delivery rods and being rotated together with the upper delivery rods; and a plurality of connecting belts connected to the upper rollers to be rotated together with the upper rollers, the connecting belt being wound on the upper rollers provided on another of the upper delivery rods.

9. The apparatus as claimed in claim 8, wherein the upper delivery rod is movable vertically along a moving rail slot formed on a side surface of the lower frame.

10. The apparatus as claimed in claim 9, wherein the upper frame is further provided with an upper elastic member for providing elastic force.

11. The apparatus as claimed in claim 10, wherein an end of the upper elastic member is fixed to the upper frame and the other end thereof is connected to the upper delivery rod.

12. The apparatus as claimed in claim 11, further comprising a power transmission gear provided at one end of the upper delivery rod and meshed with the gear of the lower frame to transmit the power of the lower power source to the upper assembly.

13. The apparatus as claimed in claim 12, wherein the delivery regulation operating unit comprises:

a delivery regulation operating rod provided rotatably on the upper frame;

an eccentric plate provided at one end of the delivery regulation operating rod and pushing the operating bar of the delivery regulating unit to rotate the operating bar; and a connecting link connecting the delivery regulation operating rod and the eccentric plate, the connecting link having both ends respectively connected to the upper frame and the main frame.

14. The apparatus as claimed in claim 13, wherein the eccentric plate comprises a circular portion connected to the end of the connecting link and a protrusion portion in contact with the operating bar to rotate the operating bar.

15. The apparatus as claimed in claim 14, wherein the main frame is further provided with an upper power source for providing power for selectively rotating the delivery regulation plate.

16. An apparatus for discharging a wad of media in an automated media dispenser, comprising:

a main frame;

a lower frame provided in the main frame, the lower frame being provided with a lower media delivery unit for conveying media in one direction;

a delivery regulating unit including a delivery regulation rod provided rotatably on the lower frame, a delivery regulation plate provided on the delivery regulation rod and being rotated together with the delivery regulation rod to selectively block the movement of the media, and an operating bar provided on the delivery regulation rod for selectively rotating the delivery regulation rod;

an upper frame provided in the main frame in correspondence to an upper side of the lower frame and being selectively in contact with the lower frame, the upper frame being provided with an upper media delivery unit, the upper media delivery unit cooperating with the lower media delivery unit to convey the media in one direction; and a delivery regulation operating unit provided in the upper frame to selectively operating the delivery regulating unit.

17. The apparatus as claimed in claim 16, wherein the operating bar is bent at least one point.

18. The apparatus as claimed in claim 17, wherein an upper plate of the lower frame is separated from the lower frame and is provided to be movable in a vertical direction along a guide formed on a side surface of the lower frame.

19. The apparatus as claimed in claim 18, a lower elastic member is further provided in an inner space of the lower frame, the lower elastic member supporting the upper plate of the lower frame and providing elastic force so that the lower frame in contact with the upper frame when the lower frame is brought into close contact with the upper frame, the lower elastic member is a compression spring.

20. The apparatus as claimed in claim 19, wherein the lower media delivery unit comprises:

a plurality of lower delivery rods installed rotatably on the lower frame;

a plurality of lower rollers provided on the lower delivery rod, the lower roller being rotated together with the lower delivery rod and selectively protruding through a through hole formed on the upper plate of the lower frame;

a lower power transmission unit provided in the lower frame and connected to the lower delivery rod to rotate the lower delivery rod; and a lower power source provided in the lower frame and generating power to be transmitted to the lower delivery rod.

* * * * *